US011175686B2

(12) United States Patent
Chen et al.

(10) Patent No.: US 11,175,686 B2
(45) Date of Patent: Nov. 16, 2021

(54) LOW-TEMPERATURE DRIFT ULTRA-LOW-POWER LINEAR REGULATOR

(71) Applicant: SOUTHEAST UNIVERSITY, Nanjing (CN)

(72) Inventors: Chao Chen, Nanjing (CN); Jun Yang, Nanjing (CN); Xinning Liu, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 12 days.

(21) Appl. No.: 16/966,476

(22) PCT Filed: Apr. 30, 2020

(86) PCT No.: PCT/CN2020/087983

§ 371 (c)(1),
(2) Date: Jul. 31, 2020

(87) PCT Pub. No.: WO2020/233382

PCT Pub. Date: Nov. 26, 2020

(65) Prior Publication Data

US 2021/0311514 A1 Oct. 7, 2021

(30) Foreign Application Priority Data

May 17, 2019 (CN) ..... 201910414672.X

(51) Int. Cl.
*G05F 1/567* (2006.01)
*G05F 1/575* (2006.01)
*G05F 1/59* (2006.01)

(52) U.S. Cl.
CPC ..... *G05F 1/567* (2013.01); *G05F 1/575* (2013.01); *G05F 1/59* (2013.01)

(58) Field of Classification Search
CPC ..... G05F 1/567; G05F 1/575; G05F 1/59
See application file for complete search history.

(56) References Cited

U.S. PATENT DOCUMENTS 3,671,770 A * 6/1972 Frederiksen ..... G05F 1/575 327/513
6,995,587 B2 2/2006 Xi
(Continued)

FOREIGN PATENT DOCUMENTS

CN 102012715 A 4/2011
CN 106940580 A 7/2017
(Continued)

*Primary Examiner* — Kyle J Moody
*Assistant Examiner* — Lakaisha Jackson
(74) *Attorney, Agent, or Firm* — Bayramoglu Law Offices LLC

(57) ABSTRACT

A low-temperature drift ultra-low-power linear regulator includes eight PMOS transistors, two resistors, two capacitors and three NMOS transistors. The eight PMOS transistors include PMOS transistor PM1 to PMOS transistor PM8. The two resistors include resistor R1 and resistor R2. The two capacitors include capacitor C1 and capacitor C2. The three NMOS transistors include NMOS transistor NM1, NMOS transistor NM2 and NMOS transistor NM3. From right to left, the linear regulator includes a PTAT voltage core starting circuit, a PTAT voltage core circuit, a negative temperature characteristic generating circuit and a driver stage closed-loop control circuit. PM5-PM8 form a feedback circuit. The feedback circuit clamps the current flowing through PM6 to be proportional to PM2 to obtain a temperature-stable output voltage, and can dynamically adjust the gate voltage of PM5 according to the change of load current to output different currents according to the load demand.

1 Claim, 1 Drawing Sheet

(56) References Cited

U.S. PATENT DOCUMENTS

| | | | | |
|---|---|---|---|---|
| 2005/0077952 | A1 | 4/2005 | Okada | |
| 2018/0059699 | A1* | 3/2018 | Wang | G05F 1/468 |
| 2019/0339730 | A1* | 11/2019 | Coln | G05F 3/262 |
| 2021/0041902 | A1* | 2/2021 | Mora-Puchalt | G05F 1/567 |

FOREIGN PATENT DOCUMENTS

| | | | |
|---|---|---|---|
| CN | 107168442 | A | 9/2017 |
| CN | 109343643 | A | 2/2019 |
| CN | 110377094 | A | 10/2019 |

* cited by examiner

LOW-TEMPERATURE DRIFT ULTRA-LOW-POWER LINEAR REGULATOR

CROSS REFERENCE TO THE RELATED APPLICATIONS

This application is the national phase entry of International Application No. PCT/CN2020/087983, filed on Apr. 30, 2020, which is based upon and claims priority to Chinese Patent Application No. 201910414672.X, filed on May 17, 2019, the entire contents of which are incorporated herein by reference.

TECHNICAL FIELD

The present invention relates to the technical field of power supply devices, and more particularly, to a low-temperature drift ultra-low-power linear regulator.

BACKGROUND

For telecom devices, the continuous power supply time of batteries depends critically on the power consumption level characteristic of the device, such as handheld terminals, Internet of Things network nodes and the like. In order to minimize the average power consumption, the power management module compresses the active time of the circuit as much as possible by means of timed wake-up. Most of the time, the chip is in a standby or sleep mode. At this time, only the low-speed clock circuit and the memory module still maintain power supply. The operating current also drops to a few microamperes or even lower. The static power consumption of the linear regulator itself, therefore, must be as low as possible to maintain high energy efficiency. Traditional linear regulators require a bandgap reference circuit to provide a stable reference voltage that does not change with temperature and voltage. Such regulators typically generate a stable output voltage by way of a closed-loop drive circuit. From the perspective of power consumption, the independent bandgap reference circuit and voltage regulation drive circuit contain numerous current branches, including several amplifiers and bias circuits. The utilization of such current branches is not conducive to achieving low bias current.

SUMMARY

An objective of the present invention is to overcome the above-mentioned problems and provide a low-temperature drift ultra-low-power linear regulator.

In order to achieve the above-mentioned objective, the present invention adopts the following technical solutions. A low-temperature drift ultra-low-power linear regulator includes eight P-channel metal oxide semiconductor (PMOS) transistors, two resistors, two capacitors and three N-channel metal oxide semiconductor (NMOS) transistors. The eight PMOS transistors include a PMOS transistor PM1 to a PMOS transistor PM8, respectively. The two resistors include a resistor R1 and a resistor R2, respectively. The two capacitors include a capacitor C1 and a capacitor C2, respectively. The three NMOS transistors include an NMOS transistor NM1, an NMOS transistor NM2 and an NMOS transistor NM3, respectively.

The source of the PMOS transistor PM1 is connected to a power source, and the gate of the PMOS transistor PM1 is connected to the source of the PMOS transistor PM2. The drain of the PM1 is connected to the positive terminal of the resistor R2, and the negative terminal of the resistor R2 is grounded.

The gate of the PMOS transistor PM2 is connected to the drain of the PMOS transistor PM1, and the drain of the PMOS transistor PM2 is grounded.

The positive terminal of the capacitor C1 is connected to the gate of the PMOS transistor PM2, and the negative terminal of the capacitor C1 is grounded.

The source of the PMOS transistor PM3 is connected to the power source, the gate of the PMOS transistor PM3 is connected to the source of the PMOS transistor PM2, and the drain of the PMOS transistor PM3 is connected to the drain of the NMOS transistor NM1.

The gate of the NMOS transistor NM1 is connected to the drain of the NMOS transistor NM1, and the source of the NMOS transistor NM1 is grounded.

The source of the PMOS transistor PM4 is connected to the power source, the gate of the PMOS transistor PM4 is connected to the source of the PMOS transistor PM2 and the drain of the PMOS transistor PM4 is connected to the drain of the NMOS transistor NM2.

The gate of the NMOS transistor NM2 is connected to the drain of the NMOS transistor NM1 and the source of the NMOS transistor NM2 is connected to the positive terminal of the resistor R1. The negative terminal of the resistor R1 is grounded.

The source of the PMOS transistor PM5 is connected to the power source, the gate of the PMOS transistor PM5 is connected to the drain of the PMOS transistor PM8, and the drain of the PMOS transistor PM5 is connected to the source of the PMOS transistor PM6.

The gate of the PMOS transistor PM6 is connected to the source of the NMOS transistor NM2, and the drain of the PMOS transistor PM6 is connected to the drain of the NMOS transistor NM3. The gate of the NMOS transistor NM3 is connected to the drain of the NMOS transistor NM1, and the source of NMOS transistor NM3 is grounded.

The source of the PMOS transistor PM8 is connected to the power source, and the gate of the PMOS transistor PM8 is connected to the source of the PMOS transistor PM2.

The source of the PMOS transistor PM7 is connected to the drain of the PMOS transistor PM8, the gate of the PMOS transistor PM7 is connected to the drain of the PMOS transistor PM6 and the drain of the PMOS transistor PM7 is grounded.

The capacitor C2 is a load capacitor of the linear regulator, the positive terminal of the capacitor C2 is connected to the drain of the PMOS transistor PM5 and the negative terminal of the capacitor C2 is grounded.

Advantages

In the present invention, the bandgap reference is integrated with the linear voltage regulator circuit to directly obtain the temperature-compensated voltage at the output end of the regulator, and a lower linear adjustment rate and a stable temperature characteristic are obtained by a feedback loop. Thus, a high degree of functional integration is achieved while minimizing the required current branches. The ultra-low power consumption and low temperature drift linear voltage regulator circuit proposed by the present invention is suitable for applications that require ultra-low standby power consumption and higher efficiency under low drive currents. The linear voltage regulator circuit has advantages such as low bias current, low-temperature coefficient, wide drive current range and high energy efficiency.

DETAILED DESCRIPTION OF THE EMBODIMENTS

The present invention will be further described in detail hereinafter with reference to the drawings and embodiments.

Figure 1:
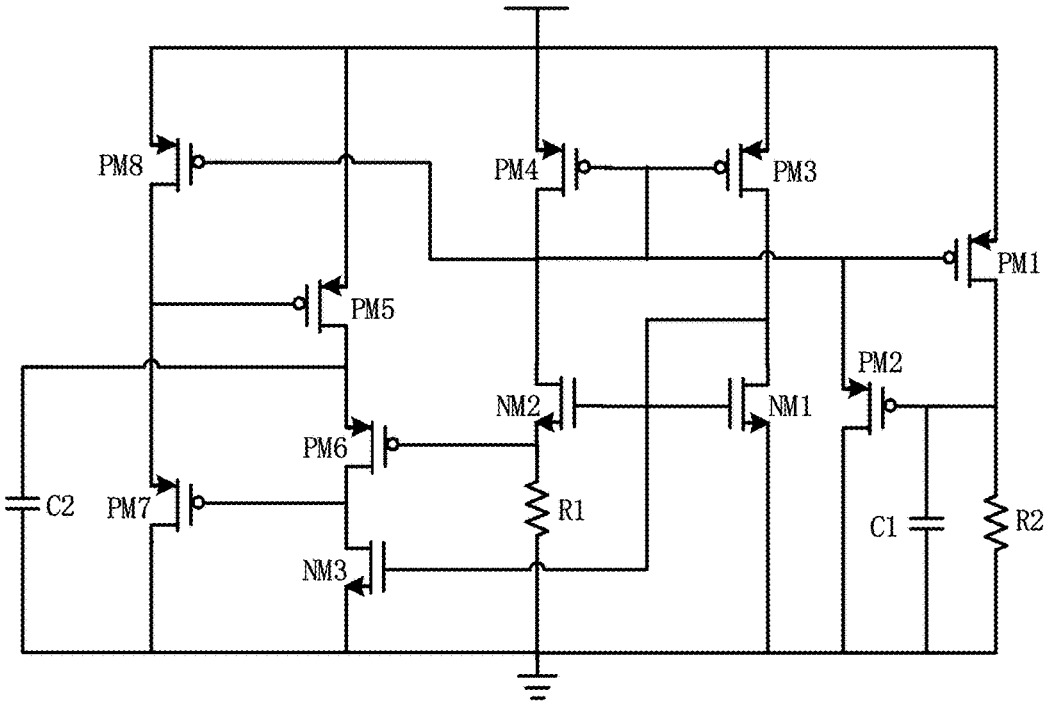
FIG. 1 is a circuit diagram of the low-temperature drift ultra-low-power linear regulator of the present invention.

FIG. 1 is a circuit diagram of the low-temperature drift ultra-low-power linear regulator of the present invention. The present invention provides a circuit of the low-temperature drift ultra-low-power linear regulator, including eight PMOS transistors, two resistors, two capacitors and three NMOS transistors. The eight PMOS transistors include the PMOS transistor PM1 to the PMOS transistor PM8, respectively. The two resistors include the resistor R1 and the resistor R2, respectively. The two capacitors include the capacitor C1 and the capacitor C2, respectively. The two NMOS transistors include the NMOS transistor NM1, the NMOS transistor NM2 and the NMOS transistor NM3, respectively.

The source of the PMOS transistor PM1 is connected to the power source. The gate of the PMOS transistor PM1 is connected to the source of the PMOS transistor PM2 and the drain of the PM1 is connected to the positive terminal of the resistor R2. The negative terminal of the resistor R2 is grounded.

The gate of the PMOS transistor PM2 is connected to the drain of the PMOS transistor PM1 and the drain of the PMOS transistor PM2 is grounded.

The positive terminal of the capacitor C1 is connected to the gate of the PMOS transistor PM2 and the negative terminal of the capacitor C1 is grounded.

The source of the PMOS transistor PM3 is connected to the power source. The gate of the PMOS transistor PM3 is connected to the source of the PMOS transistor PM2 and the drain of the PMOS transistor PM3 is connected to the drain of the NMOS transistor NM1.

The gate of the NMOS transistor NM1 is connected to the drain of the NMOS transistor NM1 and the source of the NMOS transistor NM1 is grounded.

The source of the PMOS transistor PM4 is connected to the power source. The gate of the PMOS transistor PM4 is connected to the source of the PMOS transistor PM2 and the drain of the PMOS transistor PM4 is connected to the drain of the NMOS transistor NM2.

The gate of the NMOS transistor NM2 is connected to the drain of the NMOS transistor NM1 and the source of the NMOS transistor NM2 is connected to the positive terminal of the resistor R1. The negative terminal of the resistor R1 is grounded.

The source of the PMOS transistor PM5 is connected to the power source. The gate of the PMOS transistor PM5 is connected to the drain of the PMOS transistor PM8 and the drain of the PMOS transistor PM5 is connected to the source of the PMOS transistor PM6.

The gate of the PMOS transistor PM6 is connected to the source of the NMOS transistor NM2 and the drain of the PMOS transistor PM6 is connected to the drain of the NMOS transistor NM3. The gate of the NMOS transistor NM3 is connected to the drain of the NMOS transistor NM1 and the source of the NMOS transistor NM3 is grounded.

The source of the PMOS transistor PM8 is connected to the power source and the gate of the PMOS transistor PM8 is connected to the source of the PMOS transistor PM2.

The source of the PMOS transistor PM7 is connected to the drain of the PMOS transistor PM8. The gate of the PMOS transistor PM7 is connected to the drain of the PMOS transistor PM6 and the drain of the PMOS transistor PM7 is grounded.

The capacitor C2 is a load capacitor of the linear regulator. The positive terminal of the capacitor C2 is connected to the drain of the PMOS transistor PM5 and the negative terminal of the capacitor C2 is grounded.

The operating principle of this circuit is analyzed as follows. From right to left, the entire linear regulator includes a proportional to absolute temperature (PTAT) voltage core starting circuit, a PTAT voltage core circuit, a negative temperature characteristic generating circuit and a driver stage closed-loop control circuit, respectively. PM5-PM8 form a feedback circuit. On the one hand, the feedback circuit clamps the current flowing through PM6 to be proportional to PM2, so as to obtain a temperature-stable output voltage. On the other hand, the feedback circuit can dynamically adjust the gate voltage of PM5 according to the change of load current, so as to output different currents according to the load demand. Due to the large size of PM5, the change amplitude of the drain voltage of PM6 is relatively small under different load conditions without producing a significant impact on the relationship between the current of PM6 and the current of NM2, thus ensuring that the accurate and temperature-independent voltage can be obtained under different loads.

Figure 2:
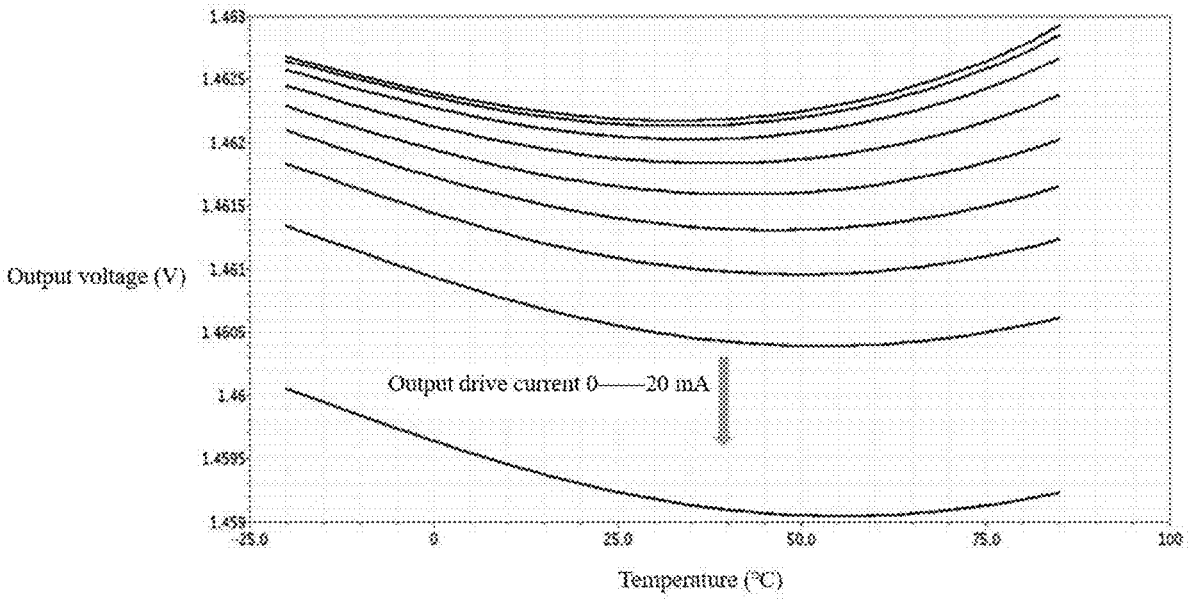
FIG. 2 is a graph showing the curves of the output voltage with the changing temperature of the linear regulator of the present invention under a drive current of 0-20 mA.

FIG. 2 is a graph showing the curves of the output voltage with the changing temperature of the linear regulator of the present invention under a drive current of 0-20 mA. The figure illustrates that the output voltage of the linear regulator exhibits high-temperature stability within the temperature range of −20 degrees Celsius to 85 degrees Celsius and forms a first-order temperature compensation characteristic. The output voltage drops slightly when the current changes from 0 to 20 mA. In the maximum drive current mode of 20 mA, the voltage change within the entire temperature range is within 1 mV.

The technical means disclosed in the technical solutions of the present invention are not limited to the technical means disclosed in the above technical solutions, and also include technical solutions obtained by any combination of the above technical features. The above description is a specific embodiment of the present invention. It should be noted that, those having ordinary skill in the art can make several improvements and modifications without departing from the principles of the present invention, and these improvements and modifications shall fall within the scope of protection of the present invention.

What is claimed is:

1. A low-temperature drift ultra-low-power linear regulator, comprising:

eight PMOS transistors, two resistors, two capacitors, and three NMOS transistors;

wherein the eight PMOS transistors comprise a first PMOS transistor, a second PMOS transistor, a third PMOS transistor, a fourth PMOS transistor, a fifth PMOS transistor, a sixth PMOS transistor, a seventh PMOS transistor and an eighth PMOS transistor;

the two resistors comprise a first resistor and a second resistor;

the two capacitors comprise a first capacitor and a second capacitor;

the three NMOS transistors comprise a first NMOS transistor, a second NMOS transistor and a third NMOS transistor;

a source of the first PMOS transistor is connected to a power source, a gate of the first PMOS transistor is connected to a source of the second PMOS transistor, a drain of the first PMOS transistor is connected to a positive terminal of the second resistor, and a negative terminal of the second resistor is grounded;

a gate of the second PMOS transistor is connected to the drain of the first PMOS transistor, and a drain of the second PMOS transistor is grounded;

a positive terminal of the first capacitor is connected to the gate of the second PMOS transistor, and a negative terminal of the first capacitor is grounded;

a source of the third PMOS transistor is connected to the power source, a gate of the third PMOS transistor is connected to the source of the second PMOS transistor, and a drain of the third PMOS transistor is connected to a drain of the first NMOS transistor;

a gate of the first NMOS transistor is connected to a drain of the first NMOS transistor, and a source of the first NMOS transistor is grounded;

a source of the fourth PMOS transistor is connected to the power source, a gate of the fourth PMOS transistor is connected to the source of the second PMOS transistor, and a drain of the fourth PMOS transistor is connected to a drain of the second NMOS transistor;

a gate of the second NMOS transistor is connected to the drain of the first NMOS transistor, and a source of the second NMOS transistor is connected to a positive terminal of the first resistor; a negative terminal of the first resistor is grounded;

a source of the fifth PMOS transistor is connected to the power source, a gate of the fifth PMOS transistor is connected to a drain of the eighth PMOS transistor, and a drain of the fifth PMOS transistor is connected to a source of the sixth PMOS transistor;

a gate of the sixth PMOS transistor is connected to the source of the second NMOS transistor, a drain of the sixth PMOS transistor is connected to a drain of the third NMOS transistor, a gate of the third NMOS transistor is connected to the drain of the first NMOS transistor, and a source of the third NMOS PMOS transistor is grounded;

a source of the eighth PMOS transistor is connected to the power source, and a gate of the eighth PMOS transistor is connected to the source of the second PMOS transistor;

a source of the seventh PMOS transistor is connected to the drain of the eighth PMOS transistor, a gate of the seventh PMOS transistor is connected to the drain of the sixth PMOS transistor, and a drain of the seventh PMOS transistor is grounded; and the second capacitor is a load capacitor of the low-temperature drift ultra-low-power linear regulator, a positive terminal of the second capacitor is connected to the drain of the fifth PMOS transistor, and a negative terminal of the second capacitor is grounded.

* * * * *